US010894179B2

(12) United States Patent
Sugihara et al.

(10) Patent No.: US 10,894,179 B2
(45) Date of Patent: Jan. 19, 2021

(54) UPPER LIMB REHABILITATION SUPPORT DEVICE

(71) Applicants: TOYOTA JIDOSHA KABUSHIKI KAISHA, Toyota (JP); RIKEN, Wako (JP)

(72) Inventors: Hisayoshi Sugihara, Aichi-gun (JP); Hitoshi Yamada, Nagakute (JP); Takashi Izuo, Toyota (JP); Masashi Yamashita, Miyoshi (JP); Keiichi Kitajo, Itabashi-ku (JP); Shingo Shimoda, Kasugai (JP)

(73) Assignees: TOYOTA JIDOSHA KABUSHIKI KAISHA, Toyota (JP); RIKEN, Wako (JP)

( * ) Notice: Subject to any disclaimer, the term of this patent is extended or adjusted under 35 U.S.C. 154(b) by 278 days.

(21) Appl. No.: 15/759,680

(22) PCT Filed: Dec. 22, 2016

(86) PCT No.: PCT/IB2016/001801
§ 371 (c)(1),
(2) Date: Mar. 13, 2018

(87) PCT Pub. No.: WO2017/109564
PCT Pub. Date: Jun. 29, 2017

(65) Prior Publication Data

US 2019/0038930 A1 Feb. 7, 2019

(30) Foreign Application Priority Data

Dec. 25, 2015 (JP) ..... 2015-254095

(51) Int. Cl.
*A63B 22/00* (2006.01)
*A61H 1/02* (2006.01)
(Continued)

(52) U.S. Cl.
CPC ..... *A63B 22/0005* (2015.10); *A61H 1/0274* (2013.01); *A63B 21/00178* (2013.01);
(Continued)

(58) Field of Classification Search
CPC ..... A63B 23/04; A63B 23/12; A63B 23/14; A63B 23/16; A63B 22/0005;
(Continued)

(56) References Cited

U.S. PATENT DOCUMENTS 4,337,050 A * 6/1982 Engalitcheff, Jr. .. A63B 21/015 434/219
4,402,502 A * 9/1983 Peters ..... A61H 1/0214 482/139
(Continued)

FOREIGN PATENT DOCUMENTS

JP 2008-194424 A 8/2008
JP 2010-201111 A 9/2010
(Continued)

OTHER PUBLICATIONS

Álvaro Costa-Garcia, et al., "A Novel Approach to the Segmentation of sEMG Data Based on the Activation and Deactivation of Muscle Synergies During Movement" IEEE Robotics and Automation Letters, vol. 3, No. 3, Jul. 2018, pp. 1972-1977.
(Continued)

*Primary Examiner* — Quang D Thanh
*Assistant Examiner* — Matthew R Moon
(74) *Attorney, Agent, or Firm* — Oblon, McClelland, Maier & Neustadt, L.L.P.

(57) ABSTRACT

An upper limb rehabilitation support device includes a first handle that is connected with a first rotating shaft, gripped by a trainee's right hand and rotated, a second handle that is connected with a second rotating shaft, gripped by a trainee's left hand and rotated, a connecting part structured so as
(Continued)

to connect the first rotating shaft and the second rotating shaft with each other and interlock rotations of the first handle and the second handle, and a switching part structured so as to switch directions of the rotations of the first handle and the second handle, which are interlocked by the connecting part, with respect to the other handles when one of the first handle and the second handle rotates.

9 Claims, 11 Drawing Sheets

(51) Int. Cl.

| | |
|---|---|
| ***A63B 21/00*** | (2006.01) |
| ***A63B 23/12*** | (2006.01) |
| ***A63B 21/055*** | (2006.01) |
| ***A63B 23/035*** | (2006.01) |
| *A63B 23/14* | (2006.01) |

(52) U.S. Cl.
CPC ..... *A63B 21/055* (2013.01); *A63B 21/151* (2013.01); *A63B 21/4035* (2015.10); *A63B 21/4049* (2015.10); *A63B 22/0002* (2013.01); *A63B 23/03533* (2013.01); *A63B 23/12* (2013.01); *A61H 1/02* (2013.01); *A61H 2201/1276* (2013.01); *A61H 2201/1635* (2013.01); *A61H 2201/1638* (2013.01); *A63B 23/14* (2013.01); *A63B 2022/0092* (2013.01); *A63B 2022/0094* (2013.01)

(58) Field of Classification Search
CPC ..... A63B 22/0002; A63B 21/055; A63B 23/03533; A63B 21/151; A63B 21/00178; A63B 21/4035; A63B 21/4049; A63B 2022/0092; A63B 2022/0094; A61H 1/00; A61H 1/02; A61H 1/0274; A61H 2201/1253; A61H 2201/1261; A61H 2201/1269; A61H 2201/1276
See application file for complete search history.

(56) References Cited

U.S. PATENT DOCUMENTS

| | | | | |
|---|---|---|---|---|
| 4,629,185 | A | 12/1986 | Amann | |
| 4,784,385 | A * | 11/1988 | D'Angelo | A63B 21/0084 482/111 |
| 6,050,897 | A * | 4/2000 | Suzuki | A63F 13/06 463/37 |
| 9,044,630 | B1 | 6/2015 | Lampert et al. | |
| 9,265,685 | B1 * | 2/2016 | McAmis | A61H 1/0274 |
| 2011/0021955 | A1 * | 1/2011 | Byblow | A61H 1/0274 601/5 |
| 2011/0300994 | A1 | 12/2011 | Verkaaik et al. | |
| 2017/0095391 | A1 * | 4/2017 | Sapin | A61B 5/4064 |

FOREIGN PATENT DOCUMENTS

| | | | |
|---|---|---|---|
| JP | 2012-5523 | A | 1/2012 |
| JP | 2012-35022 | A | 2/2012 |
| JP | 2012-115568 | A | 6/2012 |
| KR | 10-1501527 | B1 | 3/2015 |
| WO | WO 20091070042 | A2 | 6/2009 |
| WO | 2010/059066 | A1 | 5/2010 |
| WO | WO 2015/002980 | A1 | 1/2015 |

OTHER PUBLICATIONS

International Search Report dated Mar. 15, 2017 in PCT/IB2016/001801 filed Dec. 22, 2016.

Costa, Á et al., "Importance of Muscle Selection for EMG Signal Analysis during Upper Limb Rehabilitation of Stroke Patients", Engineering in Medicine and Biology Society (EMBC), 2017 39th Annual International Conference of the IEEE, Jul. 11-15, 2017, 4 pages.

Alnajjar, F. S. et al., "The role of Body Ownership and Attention to Enhance the Internal Model and Body Control Ability", International Conference on Neurorehabilitation, 2016, 2 pages.

Alnajjar, F. et al., "Muscle Synergies Indices to Quantify the Skilled Behavior in Human", Converging Clinical and Engineering Research on Neurorehabilitation II, Biosystems & Biorobotics, vol. 15, 2017, pp. 959-963.

* cited by examiner

UPPER LIMB REHABILITATION SUPPORT DEVICE

CROSS-REFERENCE TO RELATED APPLICATIONS

This application is a United States national stage application of International Application No. PCT/IB2016/001801, filed Dec. 22, 2016, which designates the United States, and claims priority to Japanese Patent Application No. 2015-254095, filed Dec. 25, 2015, and the entire contents of each of the above applications are hereby incorporated herein by reference in entirety.

BACKGROUND OF THE INVENTION

1. Field of the Invention

The invention relates to an upper limb rehabilitation support device that supports trainee's upper limb rehabilitation.

2. Description of Related Art

An upper limb rehabilitation support device is known, which includes a pair of stages structured so as to be able to move back/force and left/right on a horizontal plane and be at mirror symmetrical positions with each other, and a forearm wrist joint movement support part fixed to each of the stages (see Japanese Patent Application Publication No. 2010-201111 (JP 2010-201111 A)).

SUMMARY OF THE INVENTION

In the foregoing upper limb rehabilitation support device, since movements of the stages are limited to mirror symmetrical (anti-phase) movements, it is difficult to move the arm in various ways. Further, since no gravitational load is applied to the arms, loads applied during movements become small, and rehabilitation training with sufficient load applied may not be possible.

The invention provides an upper limb rehabilitation support device that enables arms to move in various ways and has a sufficient load applied to during movements by applying a gravitational load.

A first aspect of the invention relates to an upper limb rehabilitation support device including: a first handle that is connected with a first rotating shaft, gripped by a trainee's right hand and rotated, the first rotating shaft being directed so that a rotating direction of the first handle includes a gravitational direction component; a second handle that is connected with a second rotating shaft, gripped by a trainee's left hand and rotated, the second rotating shaft being directed so that a rotating direction of the second handle includes the gravitational direction component; a connecting part configured to connect the first rotating shaft and the second rotating shaft with each other and interlock rotations of the first handle and the second handle; and a switching part configured to switch a rotation direction of one of the first handle and the second handle with respect to a rotation direction of the other one of the first handle and the second handle. According to the first aspect of the invention, a first handle and a second handle connected with a first rotating shaft and a second rotating shaft, respectively, are gripped by trainee's hands and rotated, respectively, the first rotating shaft and the second rotating shaft being directed so that rotating directions include gravitational direction components. By applying gravitational loads to arms that operate the first handle and the second handle, it is possible to apply sufficient loads during the movements. Further, when one of the first handle and the second handle is rotated, directions of rotations of the first handle and the second handle, which are interlocked by a connecting part with respect to the other handles, are switched. Thus, by interlocking rotations of the first handle and the second handle or switching the rotating directions of the first handle and the second handle, various movements are made. At least one of the first rotating shaft and the second rotating shaft may be provided so as to direct in the perpendicular direction to the gravitational direction. Further, in the first aspect, a diameter of at least one of the first handle and the second handle may be changeable. Thus, it is possible to select the diameters of the first handle and the second handle in accordance with a purpose of rehabilitation training, thereby enhancing effectiveness of rehabilitation training and hastening recovery. In the first aspect, a base part having a movable part may be provided further, the movable part being configured to allow the first handle and the second handle to move in a rotation axis direction. The movable part may be configured to move at least one of the first handle and the second handle elastically in the rotation axis direction when external force in the rotation axis direction is applied to the at least one of the first handle and the second handle, and to move the at least one of the first handle and the second handle elastically back to original positions when the at least one of the first handle and the second handle is released from the external force in the rotation axis direction. Thus, for example, by moving at least one of the first and second handles elastically in the rotation axis direction in accordance with a movement of a trainee's paralyzed limb, the paralyzed limb is able to move more easily. In the first aspect, directions of at least one of the first rotating shaft and the second rotating shaft may be changeable between the horizontal direction and the gravitational direction. Thus, angles of at least one of the first handle and the second handle are set optimally in accordance with a purpose of rehabilitation training, thereby enhancing effectiveness of the rehabilitation training. In the first aspect, a distance between the first handle and the second handle may be changeable. Thus, trainees having different physiques are able to carry out the same exercise and therefore able to have optimal rehabilitation training. A rail part may be further provided, which connects the first handle and the second handle with each other in an inter-axial direction of the first rotating shaft and the second rotating shaft so that the first handle and the second handle are able to slide. In the first aspect, switching part may switch over among a first state in which the first handle and the second handle are interlocked and rotated in the same direction, a second state where the first handle and the second handle are interlocked and rotated in opposite directions to each other, and a third state where the first handle and the second handle rotate independently from each other. By interlocking rotations of the first handle and the second handle or switching rotating directions of the first handle and the second handle, various movements are made. In the first aspect, a first gear wheel is connected with the first rotating shaft, the connecting part includes a first pulley connected with a second gear wheel, a second pulley connected with the second rotating shaft, and a belt member that connects the first pulley and the second pulley with each other, and the switching part has a third gear wheel and a fourth gear wheel that mesh with each other, and a switching lever that changes positions of the third gear wheel and the fourth gear wheel, and, switches over among a first state where the first gear wheel and the third gear wheel mesh with each other and the third gear wheel and the second gear wheel mesh with each other as the third gear wheel and the fourth gear wheel move in accordance with an operation of the switching lever, a second state where the first gear wheel and the third gear wheel mesh with each other, the third gear wheel and the fourth gear wheel mesh with each other, and the fourth gear wheel and the second gear wheel mesh with each other as the third gear wheel and the fourth gear wheel move, and a third state where at least one of the first gear wheel and the second gear wheel meshes with neither the third gear wheel nor the fourth gear wheel as the third gear wheel and the fourth gear wheel move, so that the first gear wheel and the second gear wheel are disconnected.

According to the invention, it is possible to provide an upper limb rehabilitation support device by which various movements can be made and sufficient loads are applied during the movements by applying a gravitational load.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Herein below, embodiments of the invention are explained with reference to the drawings. An upper limb rehabilitation support device according to the first embodiment of the invention is a device that supports rehabilitation training for recovering movements of an upper limb of a trainee who is, for example, a patient with upper limb hemiplegia caused by brain disease such as stroke.

Figure 1:
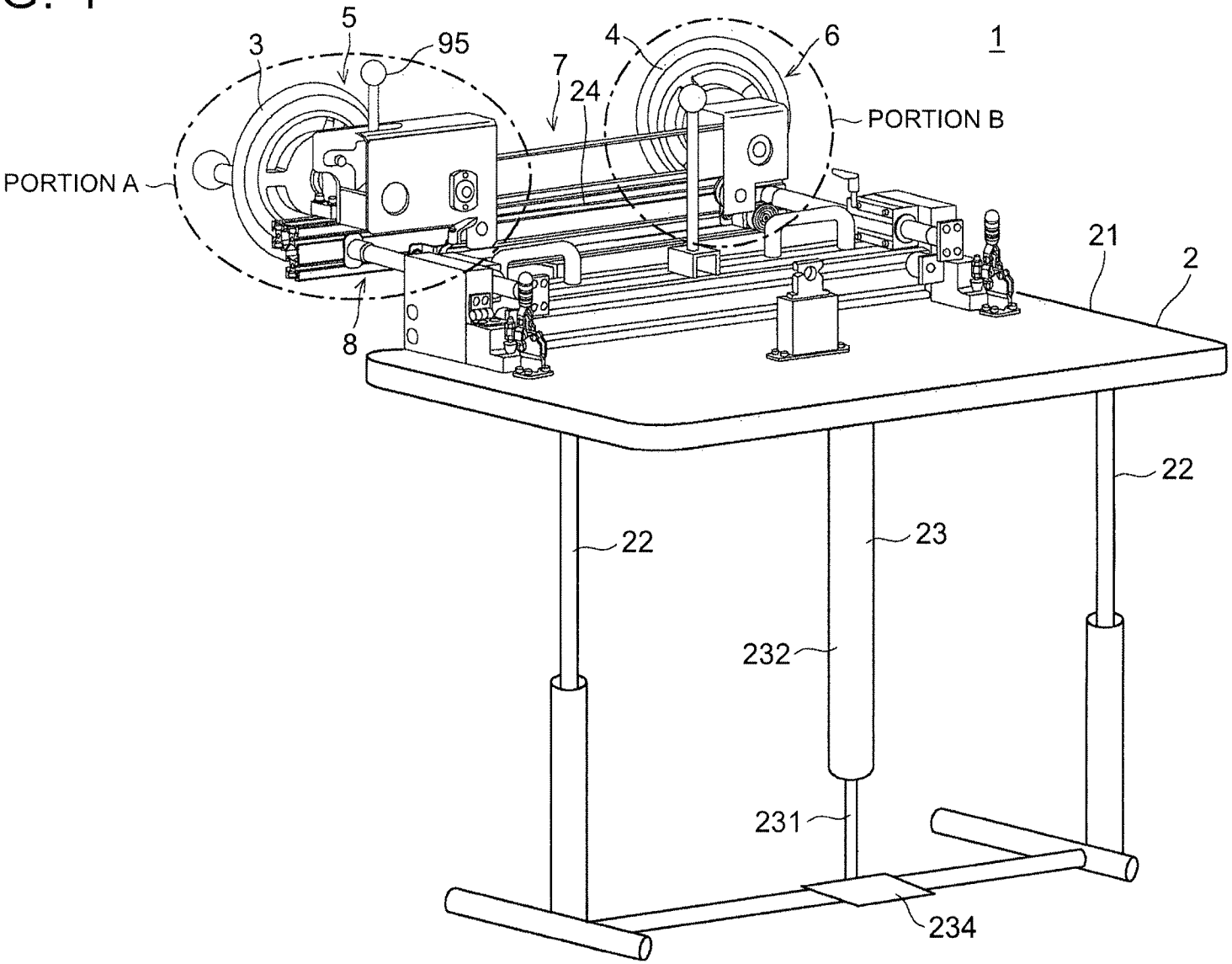
FIG. 1 is a perspective view showing a schematic structure of an upper limb rehabilitation support device according to the first embodiment of the invention.

FIG. 1 is a perspective view showing a schematic structure of the upper limb rehabilitation support device according to the first embodiment of the invention. The upper limb rehabilitation support device 1 according to the first embodiment includes a base part 2, a first rotating mechanism 5 and a second rotating mechanism 6 that are provided in the base part 2 and rotate a first handle 3 and a second handle 4 that are gripped by trainee's hands and rotated respectively, a connecting mechanism 7 that interlocks rotations of the first handle 3 and the second handle 4, and a switching mechanism 8 that switching rotating directions of the first handle 3 and the second handle 4.

With the upper limb rehabilitation support device 1, a trainee uses, for example, the right arm, which is an able arm, to rotate the first handle 3. As the second handle 4 is interlocked with the first handle 3 through the connecting mechanism 7 and rotates, the left arm, which is a paralyzed limb on the second handle 4, makes rotary movements. In this way, both the able limb and the paralyzed limb are moved in harmony. This could induce reconstruction of a neural circuit utilizing brain plasticity, and it is possible to enhance effectiveness of rehabilitation training. Alternatively, generation of myoelectricity in the paralyzed limb becomes more likely, thereby hastening recovery of the paralyzed limb. The upper limb rehabilitation support device 1 according to the first embodiment is for carrying out so-called neurorehabilitation in consideration of characteristics of the above-mentioned neural structure of the brain.

The base part 2 includes a rectangular and plate-shaped top plate 21, a pair of leg parts 22 provided in the top plate 21 so as to be able to elongate in the vertical direction, an elongating part 23 that damps elongation of each of the leg parts 22, and a rail part 24 by which the first rotating mechanism 5 and the second rotating mechanism 6 are connected with each other in a sliding manner in the lateral direction (the longitudinal direction of the rail part 24). The elongating part 23 is structured as, for example, a pedaling-type gas spring. The elongating part 23 is structured from a piston 231 and a cylinder 232, and gas is sealed in a cylinder 232. As gas inside the cylinder 232 goes in and out in accordance with stamping of the pedal 234, the piston 231 moves upwardly and downwardly, and the leg parts 22 elongate and contract. The foregoing structure of the elongating part 23 is just an example and is not limited to that.

As the leg parts 22 are caused to elongate and contract, it is possible to adjust a height position of the first handle 3 and the second handle 4 of the first rotating mechanism 5 and the second rotating mechanism 6 provided in the rail part 24. Thus, it is possible to, for example, align centers of the first handle 3 and the second handle 4 with the height position of the trainee's shoulder, thereby allowing trainees with different physiques to have the same exercise and are thus able to have optimal rehabilitation trainings.

Figure 2:
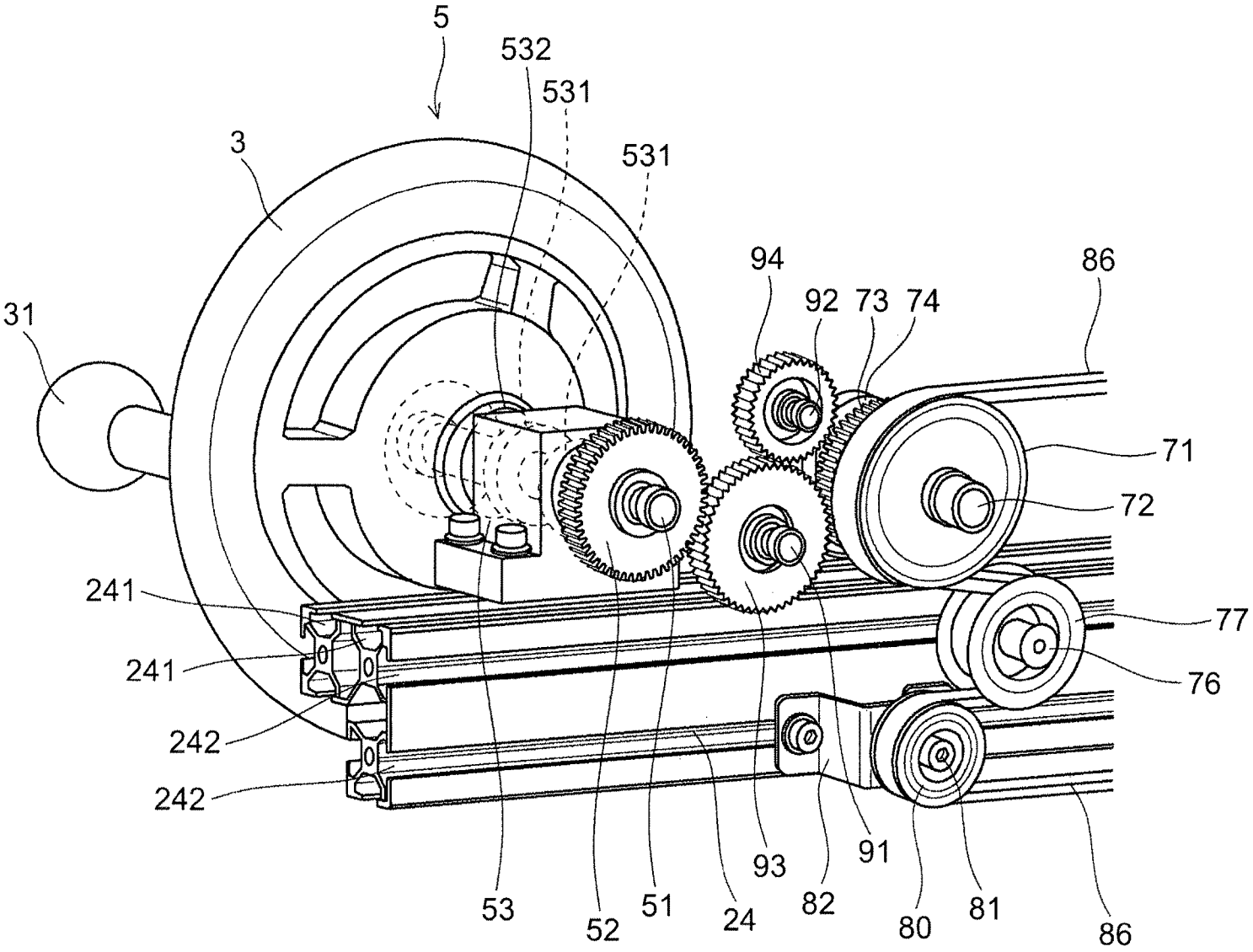
FIG. 2 is an enlarged view showing portion A of FIG. 1 and is a view of a first rotating mechanism side.
Figure 3:
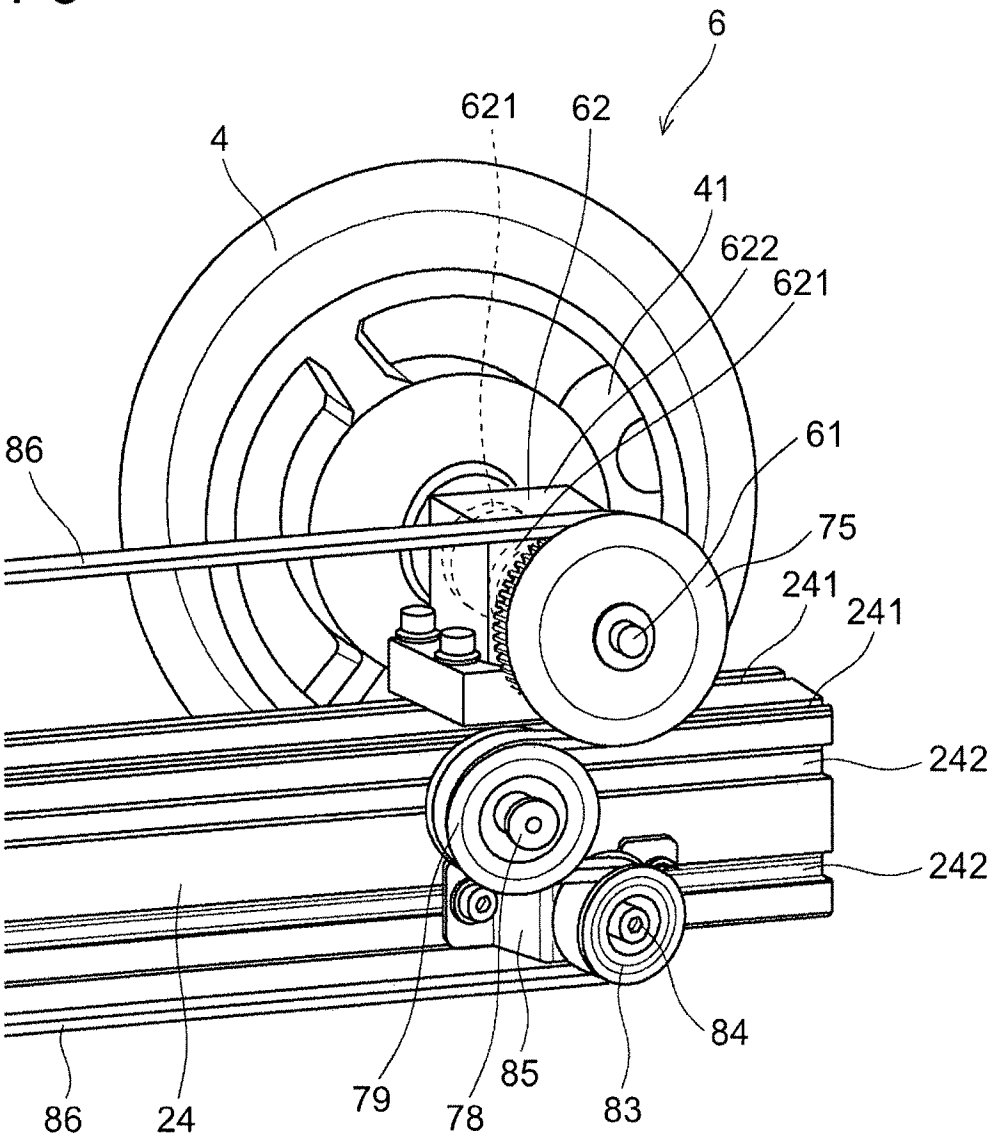
FIG. 3 is an enlarged view showing portion B in FIG. 1 and a view of a second rotating mechanism side.

FIG. 2 is an enlarged view of portion A in FIG. 1, and is a view showing the first rotating mechanism side. FIG. 3 is an enlarged view showing portion B in FIG. 1, and is a view showing the second rotating mechanism side. In an upper surface and a side surface the rail part 24, a pair of upper surface groove parts 241 and a pair of side surface groove parts 242 extending in the lateral direction are provided, respectively.

The first rotating mechanism 5 is provided on the right side of the base part 2 as seen from a trainee. The first rotating mechanism 5 has the first handle 3 that is gripped by the trainee's right hand and rotated, a first rotating shaft 51, one end of which is connected with the first handle 3, a first gear wheel 52 connected with the other end of the first rotating shaft 51, and a first shaft bearing part 53 that pivotally supports the first rotating shaft 51 so that the first rotating shaft 51 is able to rotate.

The first rotating shaft 51 is pivotally supported in the direction perpendicular to the gravitational direction (in the horizontal direction) by the first shaft bearing part 53 so that the first rotating shaft 51 is able to rotate. The first shaft bearing part 53 includes a pair of bearings 531 into which the first rotating shaft 51 is inserted and rotated, and a holding member 532 that holds each of the bearings 531. The holding member 532 is connected with the upper surface groove part 241 of the rail part 24 of the base part 2 by using, for example, four bolts and nuts. By loosening the bolts and nuts, the holding member 532, which means the first rotating mechanism 5, is moved in the lateral direction along the upper surface groove part 241.

The second rotating mechanism 6 is provided on the left side of the base part 2 as seen from a trainee. The second rotating mechanism 6 includes the second handle 4 that is gripped by the trainee's left hand and rotated, a second rotating shaft 61, one end of which is connected with the second handle 4, and a second shaft bearing part 62 that pivotally supports the second rotating shaft 61 so that the second rotating shaft 61 is able to rotate. The second shaft bearing part 62 has a pair of bearings 621 into which the second rotating shaft 61 is inserted and rotated, and a holding member 622 that holds each of the bearings 621. The holding member 622 is connected with the upper surface groove part 241 of the rail part 24 of the base part 2 by using, for example, four bolts and nuts. By loosening the bolts and nuts, the holding member 622, which means the second rotating mechanism 6, is able to move in the lateral direction along the upper surface groove part 241.

Using trainee's both arms to rotate the first handle 3 and the second handle 4 of the first rotating mechanism 5 and the second rotating mechanism 6 stated above allows the trainee to do various exercises by combining a vertical motions, lateral motions, and rotary motions of the upper limbs.

The first handle 3 and the second handle 4 may be provided with generally spherical first gripper 31 and second gripper 41 for a trainee to grip easily and rotate the first handle 3 and the second handle 4. Further, for example, the first handle 3 or the second handle 4 gripped by the hand of a paralyzed limb may be provided with a paralyzed limb immobilizing brace at a gripping position for fixing the hand of the paralyzed limb. Thus, the paralyzed limb is fixed to the first handle 3 or the second handle 4. This makes it easier for a paralyzed limb to move, improving effectiveness of rehabilitation training. Depending on a degree of paralysis, this is especially effective in a case where a trainee is not able to grip the first handle 3 and the second handle 4 at all, or in a case where hands are not easily able to trace the same plane when rotating the first handle 3 and the second handle 4.

The first handle 3 and the second handle 4 are fitted to, for example, key parts formed in the first rotating shaft 51 and the second rotating shaft 61, respectively, and are connected with the key parts by set screws on the end surfaces of the shafts. The set screws have shapes that allow them to be operated by hand easily without using tools. Therefore, it is possible to attach and remove the first handle 3 and the second handle 4 to/from the first rotating shaft 51 and the second rotating shaft 61, respectively. Also, the first handle 3 and the second handle 4 having different diameters are prepared in advance (an example of diameter changing means). Depending on rehabilitation training, it is possible to select the first handle 3 and the second handle 4 having optimal diameters, and attach them to the first rotating shaft 51 and the second rotating shaft 61, respectively.

For example, when one wants to do an exercise to induce neural circuit reconstruction by utilizing brain plasticity, the first handle 3 and the second handle 4 are rotated rapidly. Therefore, the first handle 3 and the second handle 4 having small diameters are selected and attached to the first rotating shaft 51 and the second rotating shaft 61, respectively. Meanwhile, when one wants to facilitate generation of myoelectricity, arms are moved in a greatly extended fashion. Thus; the first handle 3 and the second handle 4 having large diameters are selected, and attached to the first rotating shaft 51 and the second rotating shaft 61, respectively. As stated above, the first handle 3 and the second handle 4 having optimal diameters are selected depending on a purpose of rehabilitation training, and attached to the first rotating shaft 51 and the second rotating shaft 61, respectively. Thus, effectiveness of rehabilitation training is enhanced and recovery is hastened.

The first gripper 31 and the second gripper 41 of the first handle 3 and the second handle 4 may be provided so as to be able to move in radial directions. By moving the first gripper 31 and the second gripper 41 in the radial directions, it is possible to practically change the diameters of the handles. For example, a plurality of fixing parts (such as female threads) for fixing the first gripper 31 and the second gripper 41 are provided in the handles in the radial directions, the fixing parts are selected in accordance with required diameters, and the grippers are fixed to the fixing parts.

Incidentally, in the conventional upper limb rehabilitation support device, the operational direction is limited. Therefore, it is difficult to have an upper limb to be trained move in various ways. Further, a load applied during movements becomes small, and rehabilitation training with sufficient load application may not be possible.

On the contrary, in the upper limb rehabilitation support device 1 according to the first embodiment, the first rotating shaft 51 and the second rotating shaft 61 are provided so as to be able to rotate in the direction perpendicular to the gravitational direction as stated above, and the first handle 3 and the second handle 4 connected with the first rotating shaft 51 and the second rotating shaft 61, respectively, are gripped by trainee's hands and rotated. Thus, the by applying a gravitational load to the arms that operate the first handle 3 and the second handle 4, it is possible to apply sufficient loads during the movements. For example, there will be more vertical movements of the arms against gravity, and, as a result, a load on muscles around the upper arms or shoulders becomes great. Thus more myoelectricity is generated in a paralyzed limb and recovery of the paralyzed limb is hastened.

Furthermore, the upper limb rehabilitation support device 1 according to the first embodiment includes the connecting mechanism 7 that connects the first rotating shaft 51 and the second rotating shaft 61 of the first rotating mechanism 5 and the second rotating mechanism 6 with each other and interlocks rotations of the first handle 3 and the second handle 4, and the switching mechanism 8 that switches directions of rotations, which are interlocked by the connecting mechanism 7, of the first handle 3 and the second handle 4 with respect to the other handles when one of the first handle 3 and the second handle 4 is rotated. Thus, rotations of the first handle 3 and the second handle 4 are interlocked, or rotating directions of the first handle 3 and the second handle 4 are switched. Thus, it is possible to carry out various movements.

The connecting mechanism 7 is a specific example of connecting means. The connecting mechanism 7 has a function of connecting the first rotating shaft 51 and the second rotating shaft 61 of the first rotating mechanism 5 and the second rotating mechanism 6 with each other, and interlocking the first handle 3 and the second handle 4. The connecting mechanism 7 includes a first pulley 71, a first pulley shaft 72, a second gear wheel 73, a first pulley bearing 74, a second pulley 75, a third pulley shaft 76, a third pulley 77, a fourth pulley shaft 78, a fourth pulley 79, a fifth pulley 80, a fifth pulley shaft 81, a fifth pulley shaft supporting part 82, a sixth pulley 83, a sixth pulley shaft 84, a sixth pulley shaft supporting part 85, and a belt member 86.

The first pulley 71 is connected with one end of the first pulley shaft 72. The second gear wheel 73 is connected with the other end of the first pulley shaft 72. Therefore, the first pulley 71 and the second gear wheel 73 rotate in synchronization through the first pulley shaft 72. The first pulley bearing 74 pivotally supports the first pulley shaft 72. The first pulley bearing 74 is connected with the upper surface groove part 241 of the rail part 24 of the base part 2 on the first rotating mechanism 5 side by bolts and nuts. By loosening these bolts and nuts, it is possible to move the first pulley 71, the first pulley shaft 72, the first pulley bearing 74, and the second gear wheel 73 integrally in the lateral direction along the upper surface groove part 241.

The second pulley 75 is connected with the other end of the second rotating shaft 61. Therefore, the second pulley 75 rotates in synchronization with the second handle 4 through the second rotating shaft 61. The third pulley shaft 76 is connected with the first pulley bearing 74 through a bracket so that the third pulley shaft 76 is able to rotate. The third pulley 77 is connected with the third pulley shaft 76 so as to be able to rotate, and rotates about the third pulley shaft 76. The first pulley 71 and the third pulley 77 integrally moves in the lateral direction. The fourth pulley shaft 78 is connected with the second shaft bearing part 62 through a bracket so that the fourth pulley shaft 78 is able to rotate. The fourth pulley 79 is connected with the fourth pulley shaft 78 so as to be able to rotate, and rotates about the fourth pulley shaft 78. The second pulley 75 and the fourth pulley 79 integrally move in the lateral direction.

The fifth pulley 80 is connected with the fifth pulley shaft 81 so as to be able to rotate. The fifth pulley shaft 81 is pivotally supported by the fifth pulley shaft supporting part 82. The fifth pulley shaft supporting part 82 is connected with the side surface groove part 242 of the rail part 24 of the base part 2 on the first rotating mechanism 5 side by bolts and nuts.

The sixth pulley 83 is connected with the sixth pulley shaft 84 so as to be able to rotate. The sixth pulley shaft 84 is pivotally supported by the sixth pulley shaft supporting part 85. The sixth pulley shaft supporting part 85 is connected with the side surface groove part 242 of the rail part 24 of the base part 2 on the second rotating mechanism 6 side by bolts and nuts.

The belt member 86 is, for example, formed from an elastic member such as rubber into a ring shape. On the first rotating mechanism 5 side, the inner side of the belt member 86 hangs on the first pulley 71 and the outer side hangs on the third pulley 77, and the inner side hangs on the fifth pulley 80. On the second rotating mechanism 6 side, the inner side of the belt member 86 hangs on the second pulley 75, the outer side hangs on the fourth pulley 79, and the inner side hangs on the sixth pulley 83.

The first to sixth pulleys 71, 75, 77, 79, 80, 83 are interlocked through the belt member 86 when rotating. When, for example, the first pulley 71 rotates in the clockwise direction, the third pulley 77 rotates in the counter clockwise direction, the fifth pulley 80 rotates in the clockwise direction, the second pulley 75 rotates in the clockwise direction, the fourth pulley 79 rotates in the counter clockwise direction, and the sixth pulley 83 rotates in the clockwise direction.

The first gear wheel 52 and the second gear wheel 73 have the same number of teeth, and the first pulley 71 and the second pulley 75 have the same diameter. Therefore, as stated later, when the first rotating shaft 51 and the second rotating shaft 61 are connected with each other and the first handle 3 and the second handle 4 are interlocked, the speed of rotation of the first handle 3 and the second handle 4 is the same.

Depending on a state of a paralyzed limb to be trained, the first gear wheel 52 and the second gear wheel 73 may have different numbers of teeth or the first pulley 71 and the second pulley 75 may have different diameters. For example, when a state of paralysis is not good, the second handle 4 on the paralyzed limb side is interlocked slowly with a rotating operation of the first handle 3 on the able limb side. In such a case, for example, in order for the second handle 4 on the paralyzed limb side to rotate more slowly than the first handle 3 on the able limb, the first gear wheel 52 may have a smaller number of teeth than that of the second gear wheel 73, or the diameter of the first pulley 71 may be smaller than that of the second pulley 75.

As stated above, by moving the first rotating mechanism 5 and the second rotating mechanism 6 in the lateral direction along the upper surface groove part 241 of the rail part 24 of the base part 2, it is possible to arbitrarily adjust a center distance between the first rotating shaft 51 and the second rotating shaft 61 of the first handle 3 and the second handle 4 (a practical example of distance changing means). Thus, it is possible to, for example, adjust the center distance between the first rotating shaft 51 and the second rotating shaft 61 of the first handle 3 and the second handle 4 to meet a trainee's shoulder breadth, thereby making it possible to provide trainees having different physiques with the same exercise, and it is thus possible for trainees to carry out optimal rehabilitation training.

When adjusting the center distance between the first rotating mechanism 5 and the second rotating mechanism 6, the first rotating mechanism 5, the switching mechanism 8, and the first pulley 71 and the third pulley 77 of the connecting mechanism 7 integrally move in the lateral direction along the upper surface groove part 241 of the rail part 24 of the base part 2. Similarly, when adjusting the center distance between the first rotating mechanism 5 and the second rotating mechanism 6, the second rotating mechanism 6 and the second pulley 75 and the fourth pulley 79 of the connecting mechanism 7 integrally move in the lateral direction along the upper surface groove part 241 of the rail part 24 of the base part 2. At this time, positions of the fifth pulley 80 and the sixth pulley 83 are fixed. Because the center distance between the first rotating mechanism 5 and the second rotating mechanism 6 is shortened and extended, it is not necessary to adjust the length of belt member 86. It is possible to easily adjust the center distance between the first rotating shaft 51 and the second rotating shaft 61 of the first handle 3 and the second handle 4 without replacing the belt member 86.

The switching mechanism 8 is a specific example of switching means. The switching mechanism 8 switches over among a first state, where the first handle 3 and the second handle 4 are interlocked and rotated in the same direction, a second state where the first handle 3 and the second handle 4 are interlocked and rotated in opposite directions, and a third state where the first handle 3 and the second handle 4 are rotated independently from each other.

Figure 4:
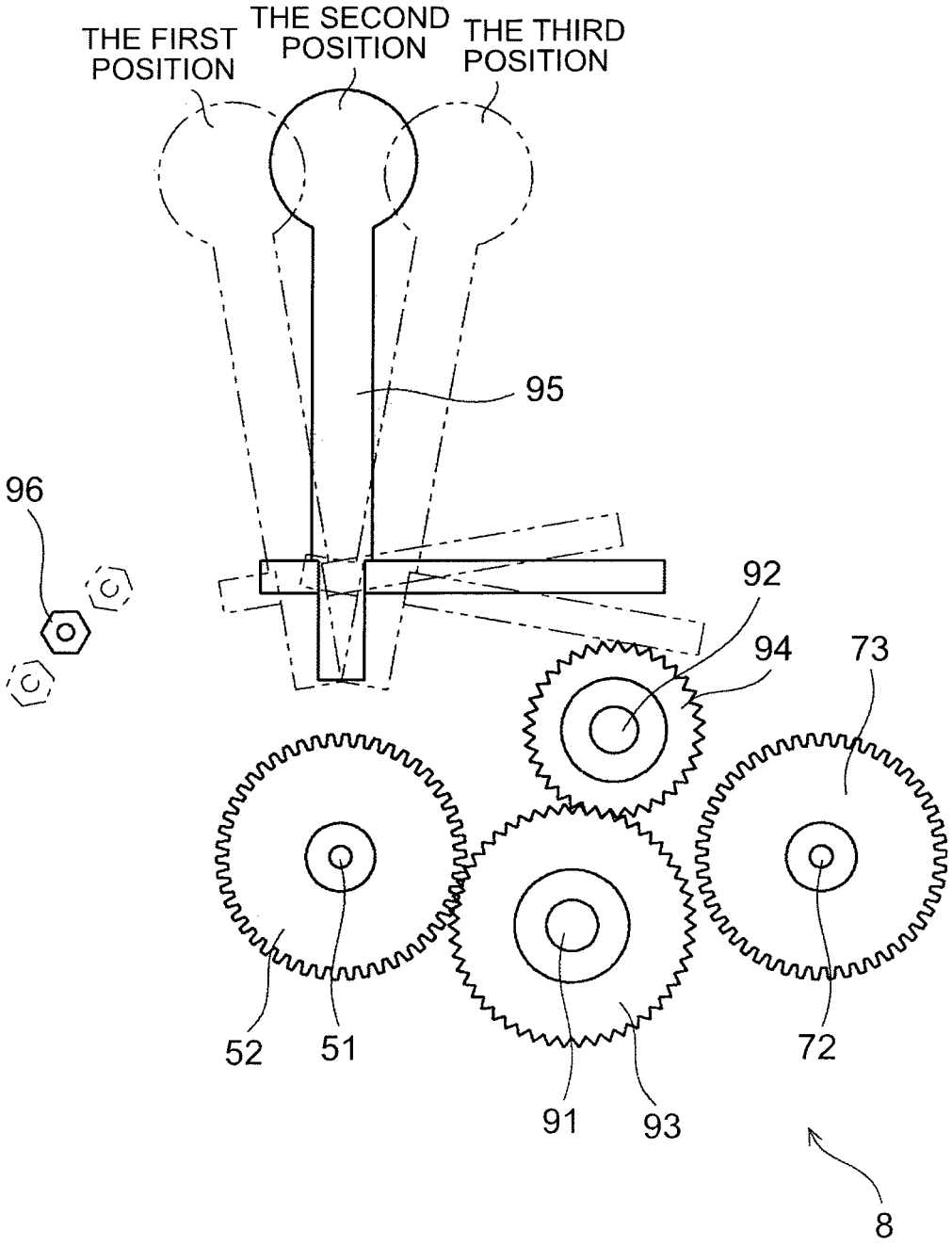
FIG. 4 is a view showing a schematic structure of a switching mechanism.

FIG. 4 is a view showing a schematic structure of the switching mechanism. The switching mechanism 8 includes a third rotating shaft 91 and a fourth rotating shaft 92 provided in the rail part 24 of the base part 2 so as to be able to move, a third gear wheel 93 connected with the third rotating shaft 91, a fourth gear wheel 94 that is connected with the fourth rotating shaft 92 and meshes with third gear wheel 93, a switching lever 95 that moves the third rotating shaft 91 and the fourth rotating shaft 92, and an indexing plunger 96 that fixes a position of the switching lever 95. For example, the fourth gear wheel 94 has smaller diameter and also a smaller number of teeth than those of the third gear wheel 93.

The switching lever 95 is a lever that a trainee is able to rock. By rocking and moving the switching lever 95 among the first through third positions, the third rotating shaft 91 and the fourth rotating shaft 92 move integrally. Then, the switching lever 95 is fixed at the first through third positions by the indexing plunger 96.

When the switching lever 95 is brought to the first position (the left position), the third rotating shaft 91 and the fourth rotating shaft 92 move to a position where the first gear wheel 52 and the third gear wheel 93 mesh with each other, and the third gear wheel 93 and the second gear wheel 73 mesh with each other (the first state). In this case, the fourth gear wheel 94 mesh with neither the first gear wheel 52 not the second gear wheel 73, and meshes with the third gear wheel 93 only. In the first state, the first handle 3 and the second handle 4 are interlocked and rotate in the same direction.

Figure 5:
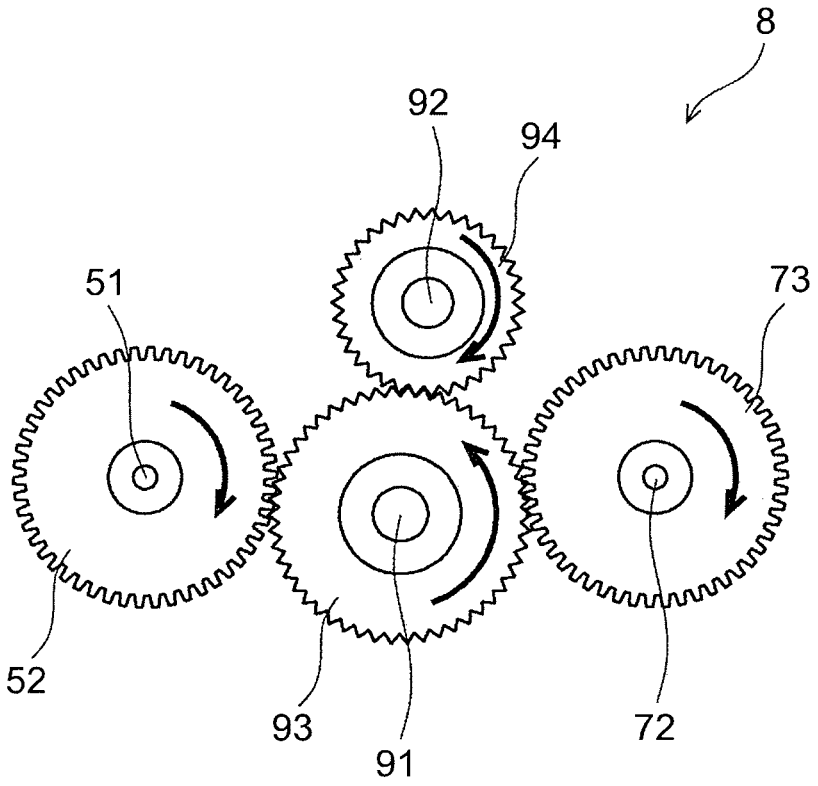
FIG. 5 is a view showing an example of a state of a first gear wheel to a fourth gear wheel in a first state.

In the first state, for example, when the first handle 3 is rotated in the clockwise direction as shown in FIG. 5, the first gear wheel 52 connected with the first handle 3 through the first rotating shaft 51 rotates in the clockwise direction, the third gear wheel 93 that meshes with the first gear wheel 52 rotates in the counter clockwise direction, the second gear wheel 73 that meshes with the third gear wheel 93 rotates in the clockwise direction, the first pulley 71 connected with the second gear wheel 73 through the first pulley shaft 72 rotates in the clockwise direction, the second pulley 75 connected with the first pulley 71 by the belt member 86 rotates in the clockwise direction, and the second handle 4 connected with the second pulley 75 through the second rotating shaft 61 rotates in the clockwise direction, the same direction as the first handle 3.

When the switching lever 95 is brought to the second position (the center position), the third rotating shaft 91 and the fourth rotating shaft 92 move to a position where the first gear wheel 52 and the third gear wheel 93 mesh with each other, the third gear wheel 93 and the fourth gear wheel 94 mesh with each other, and the fourth gear wheel 94 and the second gear wheel 73 mesh with each other (the second state). In the second state, the first handle 3 and the second handle 4 interlock and rotate in directions opposite to each other.

Figure 6:
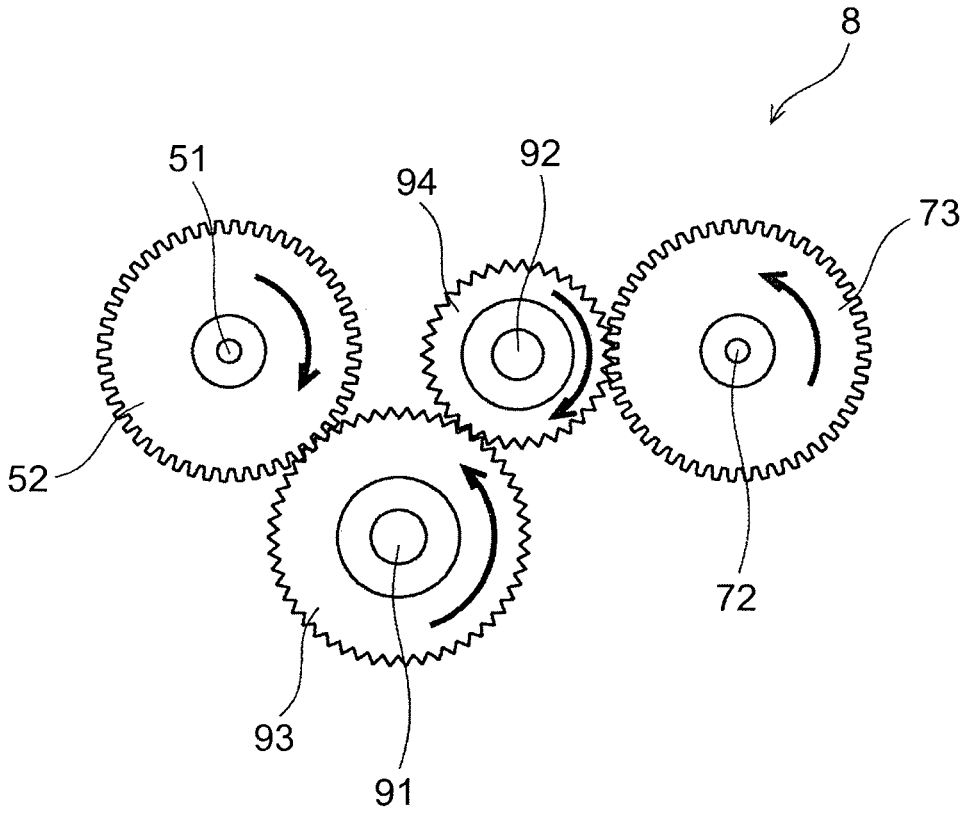
FIG. 6 is a view showing an example of a state of the first gear wheel to the fourth gear wheel in a second state.

In the second state, for example, when the first handle 3 is rotated in the clockwise direction as shown in FIG. 6, the first gear wheel 52 connected with the first handle 3 through the first rotating shaft 51 rotates in the clockwise direction, the third gear wheel 93 that meshes with the first gear wheel 52 rotates in the counter clockwise direction, the fourth gear wheel 94 that meshes with the third gear wheel 93 rotates in the clockwise direction, the second gear wheel 73 that meshes with the fourth gear wheel 94 rotates in the counter clockwise direction, the first pulley 71 connected with the second gear wheel 73 through the first pulley shaft 72 rotates in the counter clockwise direction, the second pulley 75 connected with the first pulley 71 by the belt member 86 rotates in the counter clockwise direction, the second handle 4 connected with the second pulley 75 through the second rotating shaft 61 rotates in the counter clockwise direction, which is the opposite direction to that of the first handle 3.

When the switching lever 95 is brought to the third position (the right position), the third rotating shaft 91 and the fourth, rotating shaft 92 move to a position where the first gear wheel 52 and the third gear wheel 93 mesh with each other, the third gear wheel 93 and the second gear wheel 73 do not mesh with each other (the third state). The third rotating shaft 91 and the fourth rotating shaft 92 may move to a position where the first gear wheel 52 and the third gear wheel 93 do not mesh with each other, and the third gear wheel 93 and the second gear wheel 73 mesh with each other (the third state). In this case, the fourth gear wheel 94 mesh with neither the first gear wheel 52 nor the second gear wheel 73, and meshes with the third gear wheel 93 only. In the third state, the first handle 3 and the second handle 4 rotate independently from each other.

Figure 7:
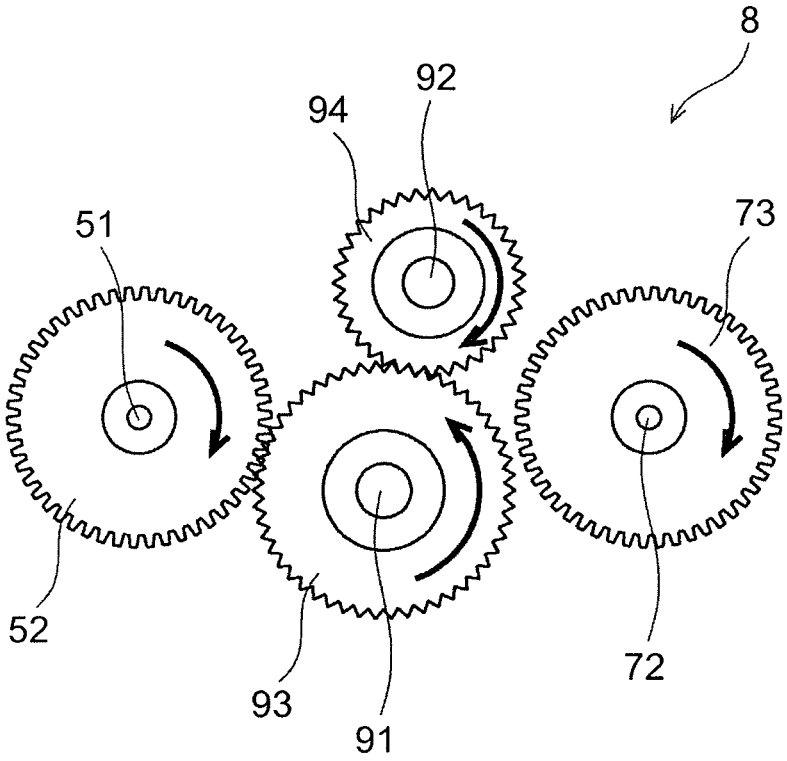
FIG. 7 is a view showing an example of a state of a first gear wheel to a fourth gear wheel in a third state.

In the third state, for example, when the first handle 3 is rotated in the clockwise direction as shown in FIG. 7, the first gear wheel 52 connected with the first handle 3 through the first rotating shaft 51 rotates in the clockwise direction, the third gear wheel 93 that meshes with the first gear wheel 52 rotates in the counter clockwise direction, and the fourth gear wheel 94 that meshes with the third gear wheel 93 rotates in the clockwise direction. However, since the third gear wheel 93 and the second gear wheel 73 do not mesh with each other, transfer of rotational force of the first handle 3 to the second handle 4 side is blocked. Meanwhile, when the second handle 4 is rotated in the clockwise direction, the second pulley 75 connected with the second handle 4 through the second rotating shaft 61 rotates in the clockwise direction, the first pulley 71 connected with the second pulley 75 by the belt member 86 rotates in the clockwise direction, and the second gear wheel 73 connected with the first pulley 71 through the first pulley shaft 72 rotates in the clockwise direction. However, since the second gear wheel 73 and the third gear wheel 93 do not mesh with each other, transfer of rotational force of the second handle 4 to the first handle 3 side is blocked. Therefore, the first handle 3 and the second handle 4 rotates completely independently from each other.

As described so far, in the first embodiment, the first rotating shaft 51 and the second rotating shaft 61 are provided so as to be able to rotate in the direction perpendicular to the gravitational direction, and the first handle 3 and the second handle 4 connected with the first rotating shaft 51 and the second rotating shaft 61, respectively, are gripped by trainee's hands and rotated. Thus, by applying gravitational loads to the trainee's arms that operate the first handle 3 and the second handle 4, it is possible to apply sufficient loads during the movements. This makes it possible to generate more myoelectricity in a paralyzed limb, and hasten recovery of the paralyzed limb.

Further, in the first embodiment, the first rotating shaft 51 and the second rotating shaft 61 of the first rotating mechanism 5 and the second rotating mechanism 6 are connected with each other, rotations of the first handle 3 and the second handle 4 are interlocked, and, when one of the first handle 3 and the second handle 4 is rotated, the rotating directions of the first handle 3 and the second handle 4, which are interlocked by the connecting mechanism 7 with respect to the other handle, are changed. Thus, by interlocking rotations of the first handle 3 and the second handle 4 or switching rotating directions of the first handle 3 and the second handle 4, various movements are made.

Figure 8:
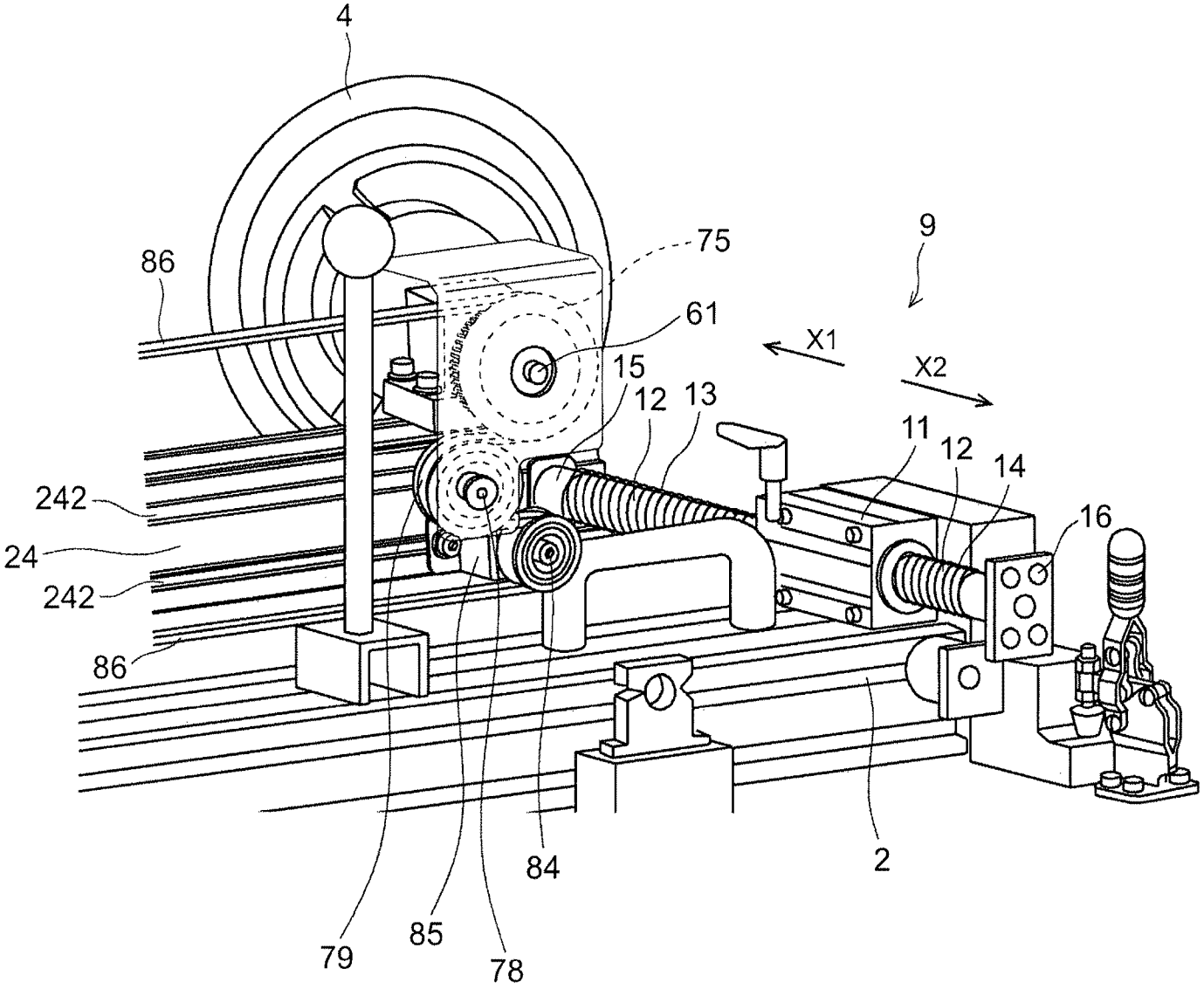
FIG. 8 is a view showing an example of a movable part.

In the second embodiment of the invention, a pair of movable parts 9 is provided on both ends of the top plate 21 of the base part 2. The movable parts 9 allow the first handle 3 and the second handle 4 of the first rotating mechanism 5 and the second rotating mechanism 6 to move in the rotation axis direction (FIG. 8). Therefore, as external force is applied to the first handle 3 and the second handle 4 in the rotation axis direction, the first handle 3 and the second handle 4 are able to elastically move in the rotation axis direction in accordance with the external force. Therefore, for example, by elastically moving the first handle 3 and the second handle 4 in the rotation axis direction in accordance with movements of a trainee's paralyzed limb, it becomes possible to move the paralyzed limb easily.

The movable parts 9 are provided in, but not limited to, both ends of the top plate 21, and the number and positions of movable parts 9 to be installed may be arbitrary. The movable parts 9 are structured so that, when external force in the rotation axis direction is applied to the first handle 3 and the second handle 4, the movable parts 9 allow the first handle 3 and the second handle 4 to move elastically in the rotation axis direction, and, when the first handle 3 and the second handle 4 are released from external force in the rotation axis direction, the movable parts 9 elastically move the first handle 3 and the second handle 4 back to the original positions.

Each of the movable parts 9 is fixed to the top plate 21, and a distal end part of each of the movable parts 9 is connected with the side surface of the rail part 24. The movable part 9 has a linear bearing part 11 fixed to the top plate 21, the shaft 12 that is pivotally supported by the linear bearing part 11 so as to be able to slide in the axis direction, and a first spring 13 and a second spring 14 provided on an outer periphery of the shaft 12.

One end of the shaft 12 is fixed to a side surface of the rail part 24 through a shaft holder 15. The other end of the shaft 12 is connected with a shaft holder 16. The first spring 13 is provided on the outer peripheral surface of the shaft 12 between the shaft holder 15 on the side surface of the rail part 24 and the linear bearing part 11. The second spring 14 is provided on the outer peripheral surface of the shaft 12 between the linear bearing part 11 and the shaft holder 16.

For example, when external force is applied to the first handle 3 and the second handle 4 in the rotation axis direction and also in direction X1 in which the first handle 3 and the second handle 4 are separated from the base part 2, the shaft 12 moves in the direction X1 through the first handle 3, the second handle 4, and the rail part 24. At this time, the linear bearing part 11 moves in direction X2 opposite to the direction X1 with respect to the shaft 12, thus causing the first spring 13 to extend and the second spring 14 to contract. Thus, the first handle 3 and the second handle 4 move elastically in the direction X1.

When the first handle 3 and the second handle 4 are released from the external force, the linear bearing part 11 moves in the direction X1 with respect to the shaft 12 due to biasing force of the contracted second spring 14. Thus, the first handle 3 and the second handle 4 moves in the direction X2 and elastically return to the original positions.

Figure 9:
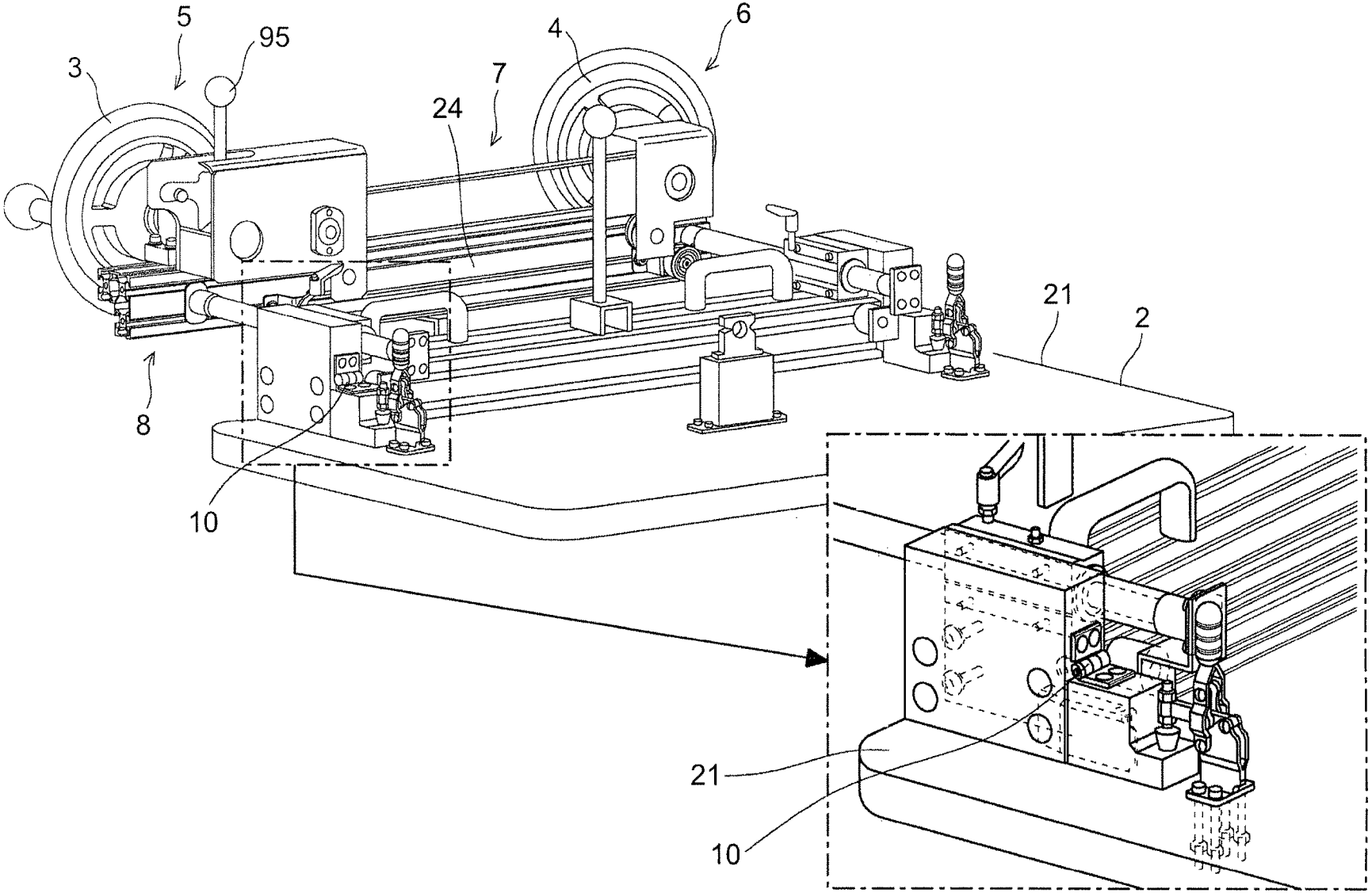
FIG. 9 is a view showing an example of a hinge part.

In the third embodiment of the invention, directions of the first rotating shaft 51 and the second rotating shaft 61 of the first rotating mechanism 5 and the second rotating mechanism 6 are changed between the horizontal direction and the gravitational direction (FIG. 9). Therefore, it is possible to optimally set angles of the first handle 3 and the second handle 4 in accordance with rehabilitation training.

Both ends of the rail part 24 are fixed to the top plate 21 through a pair of hinge parts (a specific example of means for changing rotation axis direction) 10. The rail part 24 rocks through the hinge parts 10 within the range of 0° (the first handle 3 and the second handle 4 are in the perpendicular direction, and the first rotating shaft 51 and the second rotating shaft 61 are in horizontal direction) and 90° (the first handle 3 and the second handle 4 are in the horizontal direction, and the first rotating shaft 51 and the second rotating shaft 61 are in the gravitational direction). The rail part 24 is structured so as to be fixed at two positions at 0° and 90° through the hinge parts 10, but the positions are not limited to those. For example, the rail part 24 may be structured so as to be fixed at an intermediate position at 45° or arbitrary positions at 10°, 15°, 30° and so on through the hinge parts 10.

Figure 10:
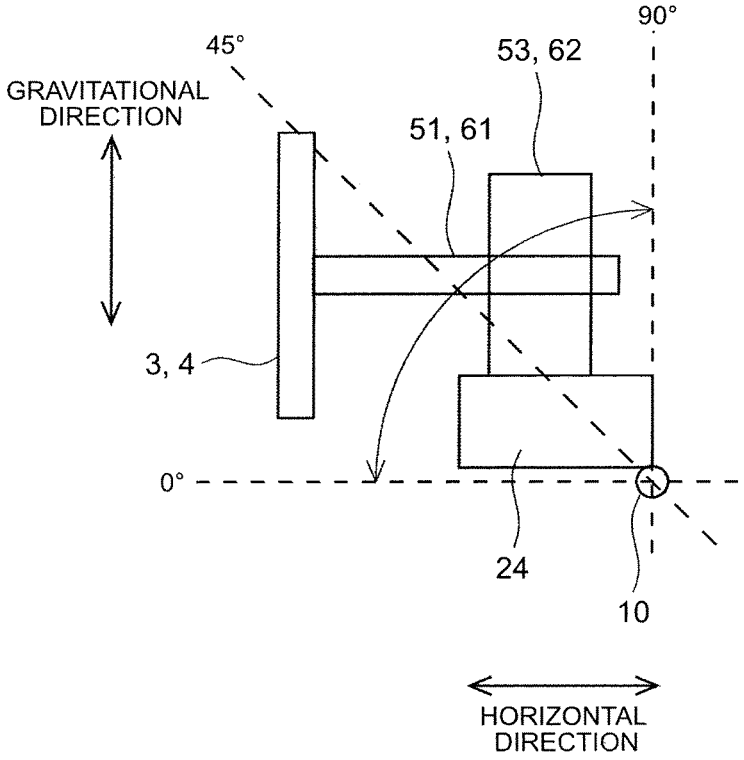
FIG. 10 is a view showing a state where a first handle and a second handle are changed from a horizontal direction to a perpendicular direction.

For example, when one wants to generate more myoelectricity, an arm is moved in a greatly extended fashion. Therefore, the rail part 24 is allowed to rock through the hinge parts 10, and, as shown in FIG. 10, the first handle 3 and the second handle 4 are set in the perpendicular direction (the position at 0° where the first rotating shaft 51 and the second rotating shaft 61 are in the horizontal direction). When one wants to induce reconstruction of a neural circuit utilizing brain plasticity, the rail part 24 is allowed to rock through the hinge parts 10, and the first handle 3 and the second handle 4 are set in the horizontal direction (the position at 90° where the first rotating shaft 51 and the second rotating shaft 61 are in the gravitational direction).

Figure 11:
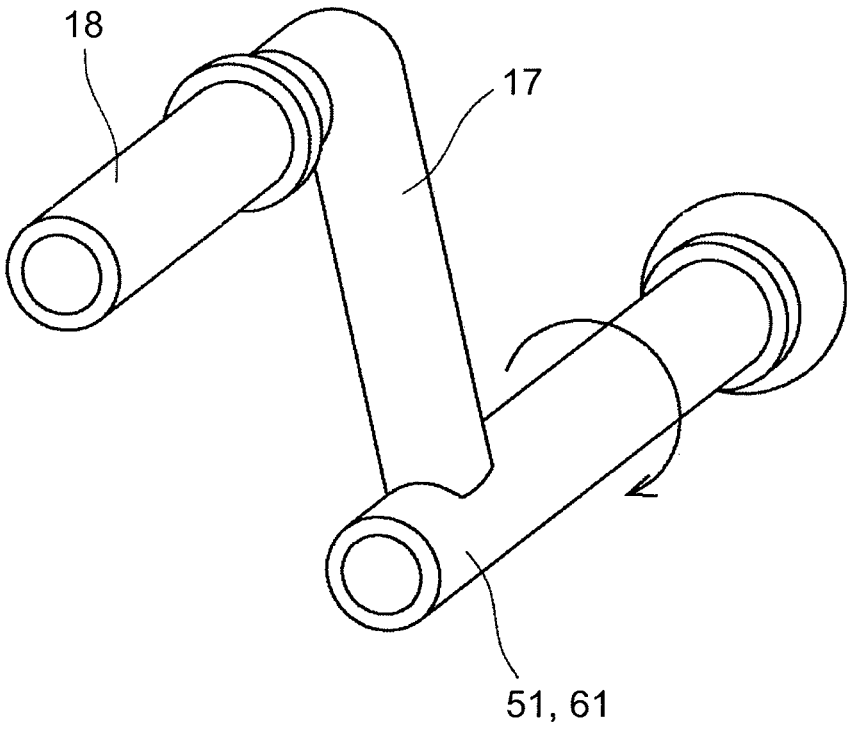
FIG. 11 is a view showing a modified example of the first handle and the second handle.

The invention is not limited to the foregoing embodiments, and it is possible to make changes as appropriate without departing from the gist of the invention. For example, in the foregoing embodiments, the first handle 3 and the second handle 4 operated by a trainee are generally circular-shaped handles, but the invention is not limited to those. For example, the invention may have a structure in which arm parts 17 are connected with the first rotating shaft 51 and the second rotating shaft 61, respectively, and grip parts 18 gripped by trainee's hands are connected with the arm parts 17, respectively (FIG. 11). A trainee grips the grip parts 18 and performs rotating operations similarly to those of the first handle 3 and the second handle 4. In the foregoing embodiments, the first handle 3 is on the able limb side and the second handle 4 is on the paralyzed limb side, but the invention is not limited to this. The first handle 3 may be on the paralyzed limb side, and the second handle 4 may be on the able limb side. Further, the invention may have a structure where the foregoing embodiments are combined arbitrarily.

The invention claimed is:

1. An upper limb rehabilitation support device comprising:

a first handle that is connected with a first rotating shaft, configured to be gripped by a right hand of a trainee and rotated, the first rotating shaft being directed so that a rotating direction of the first handle includes a gravitational direction component;

a second handle that is connected with a second rotating shaft, configured to be gripped by a left hand of the trainee and rotated, the second rotating shaft being directed so that a rotating direction of the second handle includes the gravitational direction component;

a connecting part configured to connect the first rotating shaft and the second rotating shaft with each other and interlock rotations of the first handle and the second handle; and a switching part configured to switch a rotation direction of one of the first handle and the second handle with respect to a rotation direction of the other one of the first handle and the second handle.

2. The upper limb rehabilitation support device according to claim 1, wherein at least one of the first rotating shaft and the second rotating shaft is provided so as to direct in a perpendicular direction to the gravitational direction.

3. The upper limb rehabilitation support device according to claim 1, wherein a diameter of at least one of the first handle and the second handle is changeable.

4. The upper limb rehabilitation support device according to claim 1, further comprising;

a base part in which a movable part is provided, the movable part being configured to allow the first handle and the second handle to move in a rotation axis direction, wherein the movable part is configured to move at least one of the first handle and the second handle elastically in the rotation axis direction when external force in the rotation axis direction is applied to the at least one of the first handle and the second handle, and move the at least one of the first handle and the second handle elastically back to original positions when the at least one of the first handle and the second handle is released from the external force in the rotation axis direction.

5. The upper limb rehabilitation support device according to claim 1, wherein a direction of at least one of the first rotating shaft and the second rotating shaft is changeable between a horizontal direction and the gravitational direction.

6. The upper limb rehabilitation support device according to claim 1, wherein a distance between the first handle and the second handle is changeable.

7. The upper limb rehabilitation support device according to claim 6, further comprising:

a rail part that connects the first handle and the second handle with each other in an inter-axial direction of the first rotating shaft and the second rotating shaft so that the first handle and the second handle are able to slide.

8. The upper limb rehabilitation support device according to claim 1, wherein the switching part switches over among a first state in which the first handle and the second handle are interlocked and rotate in the same direction, a second state where the first handle and the second handle are interlocked and rotate in opposite directions to each other, and a third state where the first handle and the second handle rotate independently from each other.

9. The upper limb rehabilitation support device according to claim 8, wherein a first gear wheel is connected with the first rotating shaft, the connecting part includes a first pulley connected with a second gear wheel, a second pulley connected with the second rotating shaft, and a belt member that connects the first pulley and the second pulley with each other, the switching part has a third gear wheel and a fourth gear wheel that mesh with each other, and a switching lever that changes positions of the third gear wheel and the fourth gear wheel, and switches over among the first state where the first gear wheel and the third gear wheel mesh with each other and the third gear wheel and the second gear wheel mesh with each other as the third gear wheel and the fourth gear wheel move in accordance with an operation of the switching lever, the second state where the first gear wheel and the third gear wheel mesh with each other, the third gear wheel and the fourth gear wheel mesh with each other, and the fourth gear wheel and the second gear wheel mesh with each other as the third gear wheel and the fourth gear wheel move, and the third state where at least one of the first gear wheel and the second gear wheel meshes with neither the third gear wheel nor the fourth gear wheel as the third gear wheel and the fourth gear wheel move, so that the first gear wheel and the second gear wheel are disconnected.

* * * * *